United States Patent [19]

Rova

[11] Patent Number: 4,518,306

[45] Date of Patent: May 21, 1985

[54] DEVICE IN A BUCKET-PROVIDED LOADING MACHINE PARTICULARLY A SO-CALLED WHEEL LOADER

[76] Inventor: Jan-Erik Rova, Lärkvägen 20, S-981 37 Kiruna, Sweden

[21] Appl. No.: 527,647

[22] PCT Filed: Nov. 23, 1982

[86] PCT No.: PCT/SE82/00394

§ 371 Date: Jul. 22, 1983

§ 102(e) Date: Jul. 22, 1983

[87] PCT Pub. No.: WO83/01973

PCT Pub. Date: Jun. 9, 1983

[30] Foreign Application Priority Data

Nov. 24, 1981 [SE] Sweden ..... 8106990

[51] Int. Cl.[3] ..... E02F 3/64

[52] U.S. Cl. ..... 414/726; 414/722; 37/118 A

[58] Field of Search ..... 414/726, 722, 685, 704, 414/715; 37/118 R, 118 A, 119

[56] References Cited

U.S. PATENT DOCUMENTS 1,973,950 9/1934 Frank ..... 414/722
3,070,246 12/1962 Johnson ..... 414/726
3,341,041 9/1967 Salna ..... 414/726

FOREIGN PATENT DOCUMENTS 1456608 12/1966 Fed. Rep. of Germany ..... 414/685
1578437 3/1969 France ..... 414/685

*Primary Examiner*—Leslie J. Paperner
*Assistant Examiner*—Terrance L. Siemens
*Attorney, Agent, or Firm*—Pollock, Vande Sande & Priddy

[57] ABSTRACT

Improvement in a bucket-equipped loading machine, particularly a so-called wheel loader, having at one end of the machine a loading bucket which is supported for raising and lowering movements by a pair of lift arms, journalled in the machine, and which is pivotally connected with the free ends of said arms and lockable in position relative thereto. In order to allow an improved weight distribution of such a machine when loaded and hence reduced wear and simultaneously increased relative load capacity it is suggested according to the invention that at the side (13) of the bucket (6) facing the machine said bucket is at least partly open and connected with a rear bucket portion (14) which is located between the lift arms and which extends in between the wheels (7) of the adjacent wheel axle (2) of the machine and preferably in over said axle and in that said rear bucket portion (14) is separately pivotably and lockably connected with the lift arms (8) on an axis (15) parallel to the pivot axis (9) of the load bucket (2), the lift arms (8) furthermore being curved downwardly-forwardly and adapted to form a support during loading and transport to the rear portion (14) of the bucket resting thereon and having a corresponding curved shape.

4 Claims, 7 Drawing Figures

A - A

DEVICE IN A BUCKET-PROVIDED LOADING MACHINE PARTICULARLY A SO-CALLED WHEEL LOADER

TECHNICAL FIELD

The present invention concerns an improvement in a bucket-equipped loading machine, a so-called wheel loader, which has a loading bucket at one end of the machine, the bucket being supported for raising and lowering movements by a pair of lift arms which are journalled in the machine, the bucket furthermore being pivotally connected with the free ends of the arms and lockable in position relative thereto.

BACKGROUND ART

For loading of mass or bulk material loading machines long have been in use which are equipped with a loading bucket, mostly wheel-equipped machines or so-called wheel loaders. Such machines cooperate with transport vehicles in the form of trucks or the like for removal of the bulk material, at least for longer transport distances. On the other hand, the use of separate trucks for the transport of the bulk material for shorter transport distances is unnecessary since the loading machine can be used also for the transport. This last-mentioned method has particularly become applied in mines, tunnelling works and other places where the space is restricted and the transport distances relatively short, of the order of less than 500 m. For economical reasons the development of such machines has moved towards ever-increasing machines sizes. In practical use, as large a machine as altogether there is room for within a mine or tunnel gallery, now is applied. The bucket volumes of such machines now exceed 6 $m^3$ and the load weights are of the magnitude of 15 metric tons.

It is obvious that such load weights require great wheels on the loading machine with subsequent increased wheel radius and hence increased distance of the centre of gravity of the load in the bucket from the adjacent wheel axle. In its turn, this requires a more and more rearwardly moved location of the heaviest parts of the machine such as the engine and the like for counter-balancing the load in the bucket.

These conditions imply, however, that the load variations, particularly concerning the wheel axle which is closest to the bucket, will be very great and the machine will have poor driving characteristics, particularly at full load. Such a load distribution at full load also results in a rapid wear of the tires, particularly on the wheels closest to the bucket, as well as rapid wear of the machine as a whole, dependent on how it is operated. During loading the machine is driven with full power into the heap of bulk material to be loaded. Then the operator of the machine, while progressively raising and rearwardly tilting the bucket in jerks, moves the machine into the heap in order to maximize the volume of material in the bucket as far as possible. In mines where the environment is extremely straining the wear of the machine of course will be still worse.

In order to achieve a better load distribution and hence a reduced wear of the machine or vehicle for the uses in question there have previously been made various suggestions and among those there can be referred to the Swedish Patent Specification No. 222,654. In this specification is disclosed a loading vehicle with a loading basket in which the basket-carrying portion of the vehicle is provided with a loading bucket attachment in order to allow self-loading of the vehicle. The loading bucket turned out to be too small in relation to the load basket volume, making it necessary progressively to move the vehicle into the heap of bulk material as the loading proceeded. Another suggestion of similar type is described in the Swedish Patent Specification No. 305,634. This specification disclosed a self-loading vehicle or a loading machine equipped with a tiltable load basket. Although such structure implied substantial improvements when compared with the structure according to said first-mentioned Swedish Patent Specification, the loading of the load basket by means of the bucket still required progressive movements of the vehicle, even if the loaded vehicle exhibits a more advantageous weight distribution in loaded condition.

DISCLOSURE OF THE INVENTION

The main object of the present invention is to suggest a further improvement of such a loading machine with a loading bucket which has been modified and improved in order to provide for greater load volumes than hitherto possible, but to provide simultaneously a better weight distribution of the loaded vehicle than in prior structures having a spearate load basket.

This is achieved according to the present invention substantially in that, at the side of the bucket facing the machine, the bucket is at least partly open and connected with a rear bucket portion which is located between the lift arms and which extends in between the wheels of the adjacent wheel axle of the machine. Preferably the rear bucket portion extends in over the adjacent wheel. The rear bucket portion is separately and lockably connected with the lift arms on an axis parallel to the pivot axis of the load bucket. The lift arms furthermore are curved downwardly-forwardly and adapted to form a support during loading and transport to the rear portion of the bucket resting thereon and having a corresponding curved shape.

As a result of the invention, the load bucket will have a greater effective volume and the center of gravity of the load in the bucket and the increased volume, inclusive, will be located in a very beneficial manner close to the wheel axle adjacent the bucket. This provides for a very substantial improvement of the weight distribution of the loaded machine. Since the load bucket furthermore is resting on the lift arms during loading and transport, the bucket and particularly the rear portion thereof can be made lighter, which also has a beneficial effect on the total economy of the machine.

BRIEF DESCRIPTION OF THE DRAWINGS

By the way of example, the invention will be further described below with reference to the accompaning drawings in which.

BEST MODE FOR CARRYING OUT THE INVENTION

Figure 1:
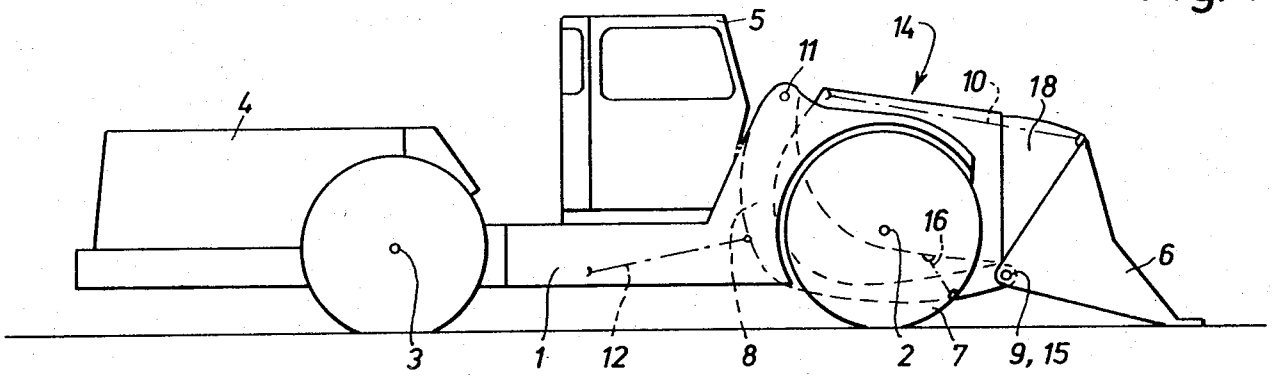
FIG. 1 is a diagrammatical side elevational view and FIG. 2 a plan view from above of a loading machine with a bucket device according to the invention.
Figure 2:
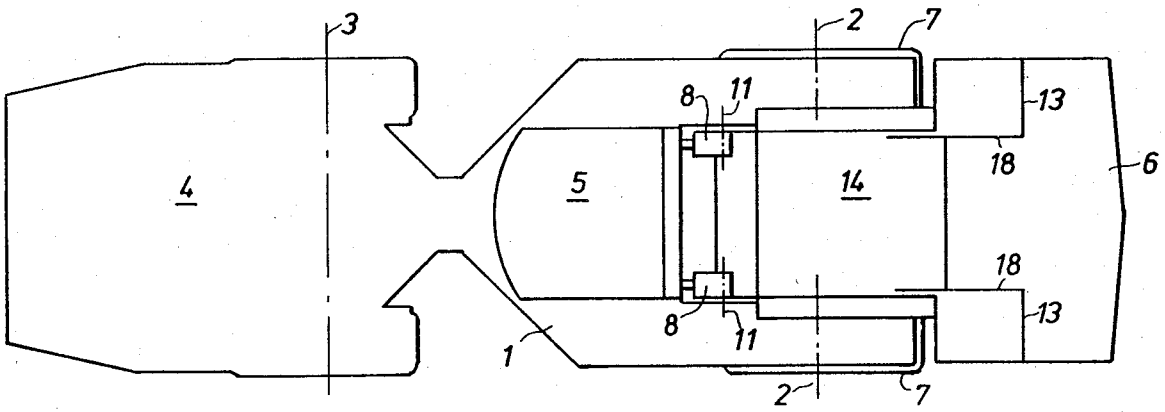

The drawings illustrate a loading machine of the wheel loader type comprising a wheel-supported chassis or a frame 1 having at least two wheel axles 2, 3, and engine 4, a driver's compartment 5 and a load bucket 6. In a known manner, bucket 6 is mounted at one end of the machine and at shortest possible distance longitdinally outside the wheels 7 of the adjacent wheel axle 2. The bucket is supported for a raising and lowering motion by a pair of lift arms 8, journalled in the machine. In the embodiment illustrated, the machine is provided with frame steering, i.e. the frame is articulated about a vertical axis at a location in the middle thereof. The articulation movement for the steering is controllable by means of suitable means not illustrated, particularly hydraulic cylinders, as known per se.

The bucket 6 is mounted or its lower side at the free ends of the lift arms 8 so as to be pivotable about a horizontal transverse axis 9. The pivotal motion of the bucket is provided by means of suitable elements, particularly hydraulic cylinders 10. At their other ends, the lift arms 8 are pivotally journalled at pivots 11 in a portion of the machine, connected with the frame 1 thereof. The pivotal motion of the lift arms 8 about their pivots 11 is provided by means of suitable, known elements and particularly hydraulic cylinders 12, connected with the machine frame 1.

According to the present invention the bucket 6 is made at least partly open at rear side 13 facing the machine and opening into to a rear bucket portion 14 which is located between the lift arms 8. Bucket portion 14 extends in between the wheels 7 of the adjacent wheel axle 2 of the machine this preferably also in over said axle. Rear bucket portion 14 is separately pivotably connected on its lower side with the lift arms 8 on an axis 15 parallel to the pivotal axis 9 of the bucket 2 and is lockable in its position. The pivotal motion of the rear bucket portion 14 about the axis 15 is provided in a known manner by means of suitable elements, in the present case hydraulic cylinders 16 acting between the rear bucket portion 14 and the lift arms 8.

Figure 4:
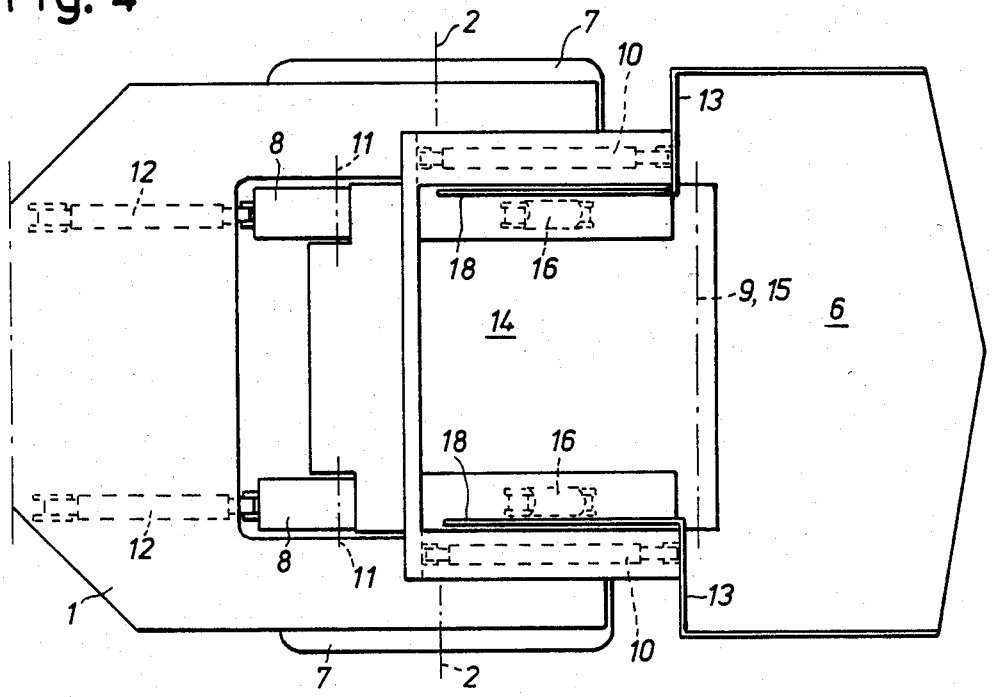
FIG. 4 is a plan view from above of the front portion of the machine for better illustration of the load bucket and the rear portion thereof.

According to the invention the left arms 8 curve downwardly and forwardly from pivots 11 in the machine toward the pivot axis 9 of the bucket 6. The rear portion 14 of the bucket 6 extends laterally over the lift arms 8 and is there provided with a curved shape corresponding to the curvature of the lift arms at the lower and rear portion of the side walls of said rear bucket portion 14. As a result of this configuration, bucket portion 14 will rest against the upper surfaces of the lift arms 8 during loading and hauling. In its turn this implies that rear bucket portion 14 will be supported such that it can be made of cheaper, thinner and lighter material, which acts beneficially on the total economy of the machine (see FIGS. 4 and 6).

Thus the bucket 6 and the rear bucket portion 14 are individually pivotable to and from each other on the pivot axis 9 and 15, respectively, which for the rest might coincide with advantage. During the mutual pivotal movements between the bucket 6 and its rear portion 14 there might occur a wedge-like opening between the rear wall 13 of the bucket and the leading side edge of the rear portion 14. To prevent bulk material from falling out through such an opening, a baffle wall 18 shaped as a sector of a circle extends rearwardly from the inner edge of each rear wall portion 13 of the bucket 6.

Figure 3:
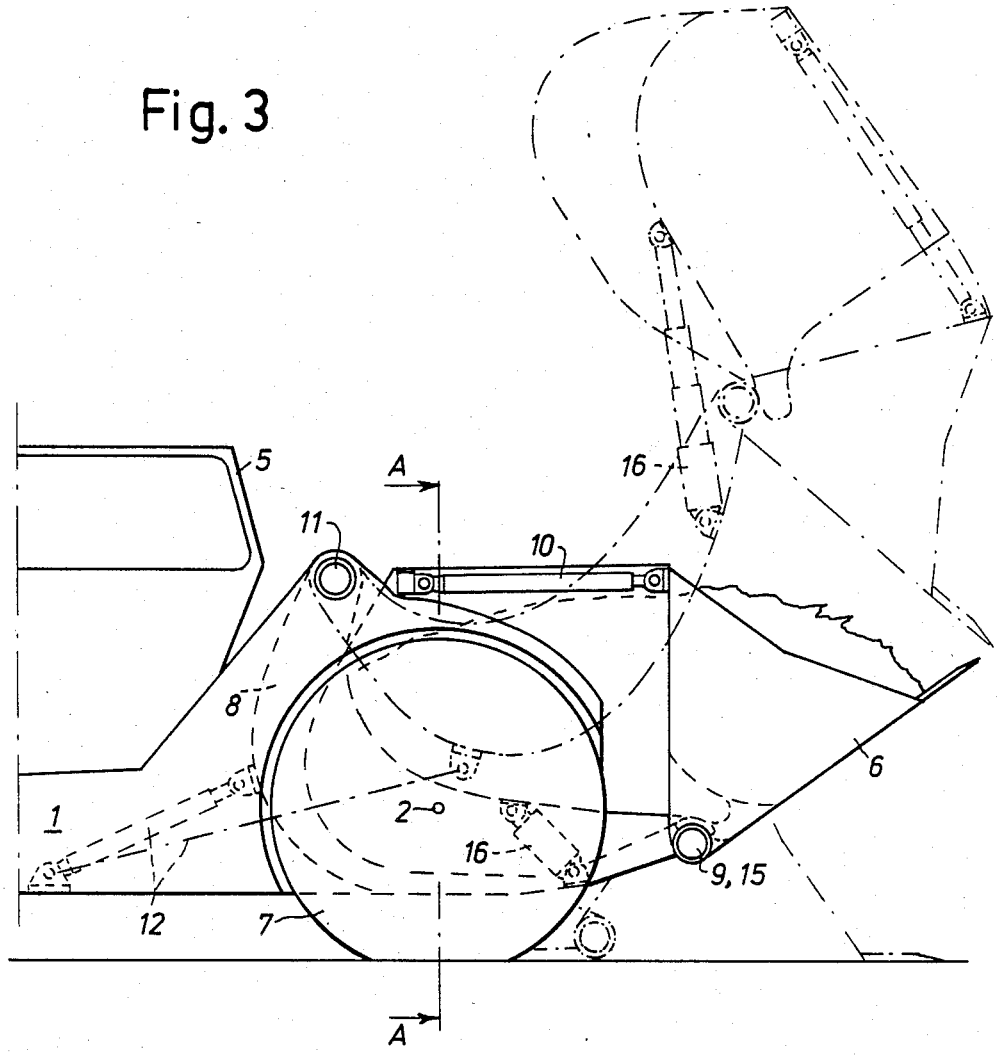
FIG. 3 is a diagrammatical side elevational view of the front portion of said machine with various positions of lift arms, load bucket with rear portion thereof and hydraulic cylinders indicated with broken lines.
Figure 6:
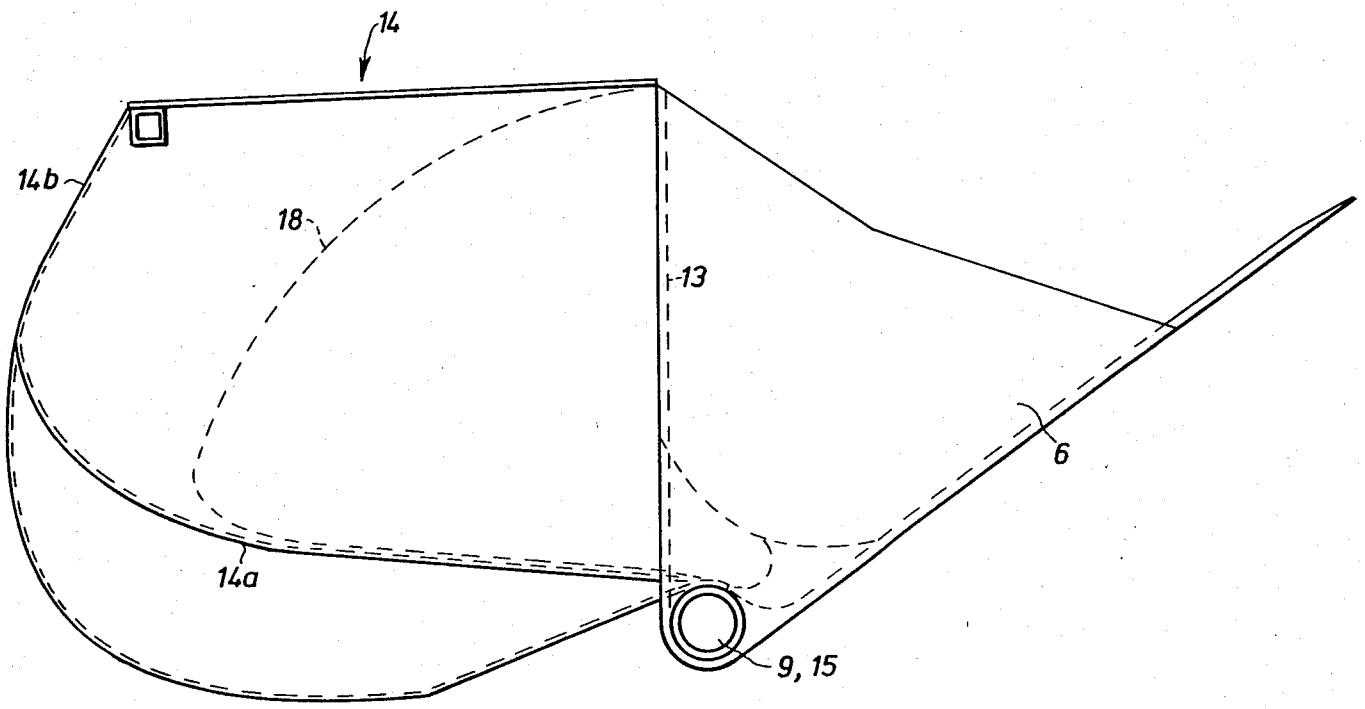
FIG. 6 is a side elevational view of the load bucket and its rear portion.

In FIG. 3 of the drawings there have been illustrated some different positions of the load bucket 6, the rear load bucket portion 14 and the lift arms 8. With full lines the load bucket 6 has been shown pivoted upwardly to its rearmost position in abutment against the front edge of the rear bucket portion 14. This position normally is the hauling position in loaded condition; therefore, a convex upper surface contour of the bulk material in the bucket 6 has been illustrated. Moreover, FIG. 6 shows with broken lines the lowermost position of the bucket 6 in engagement with the ground and also the ultimately raised position of the lift arms 8 which is used when the unified load bucket 6, 14 is to be emptied. During emptying the bucket 6 is forwardly and downwardly from its position illustrated by full lines in said Figure relative the bucket portion 14. This movement is achieved by means of the hydraulic cylinders 10, which are arranged along the upper edge of the rear bucket portion 14 and act between the rear bucket portion 14 and the upper edge of the rear wall 13 of the bucket 6. It is also clearly evident from the tipping or unloading position illustrated with broken lines how advantageously the pivotal mounting 9, 15 of the combined bucket is designed according to the invention. That is, the mounting is located closely adjacent to the middle of the length of the combined bucket 6, 14 and hence close to the center of gravity of the load therein. As a result, only relatively small tipping forces are required from the tipping cylinders 16 for providing the tipping motion. Furthermore the height requirement will be limited and at the same time the front wall of the bucket 6 still will be sufficiently raised for allowing tipping over the upper edge of the wall of a load platform on a truck. The uppermost location of the rear wall of the rear bucket portion 14 will not be located at a higher distance from the ground than what has been common in conventional bucket structures.

Figure 5:
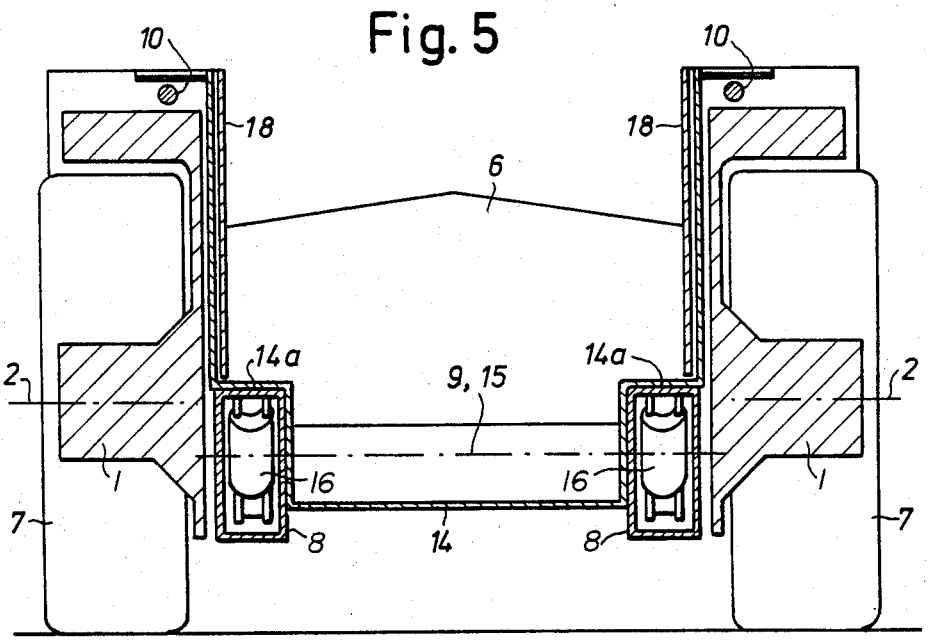
FIG. 5 is a cross-sectional view of the front portion of the machine according to the line A—A in FIG. 3 and the line 2—2 of FIG. 5.

FIG. 5 shows that advantageously the rear bucket portion 14 can be made so deep that its bottom is located at a substantial distance below the wheel axle 2. As is easily seen by those skilled in the art the center of gravity of the bulk material in the rear bucket portion 14 hence also will be located at a low level and at a relatively short distance above the wheel axle 2. This has a very advantageous influence upon the driving characteristics of the vehicle, particularly as far as lateral forces and tire wear caused thereby is concerned.

The design of the combined load bucket 6, 14 according to the invention also is clearly evident from the side elevational view in FIG. 6. Particularly it is evident that the shoulders **14*a* at the lower and rear portions of the side walls of the bucket portion 14 have a contour in said side elevational view which corresponds to the shape of the upper surface of the lift arms 8 so that the bucket portion 14 thus can rest on said arms and be supported thereby. See also FIG. 5**.

Figure 7:
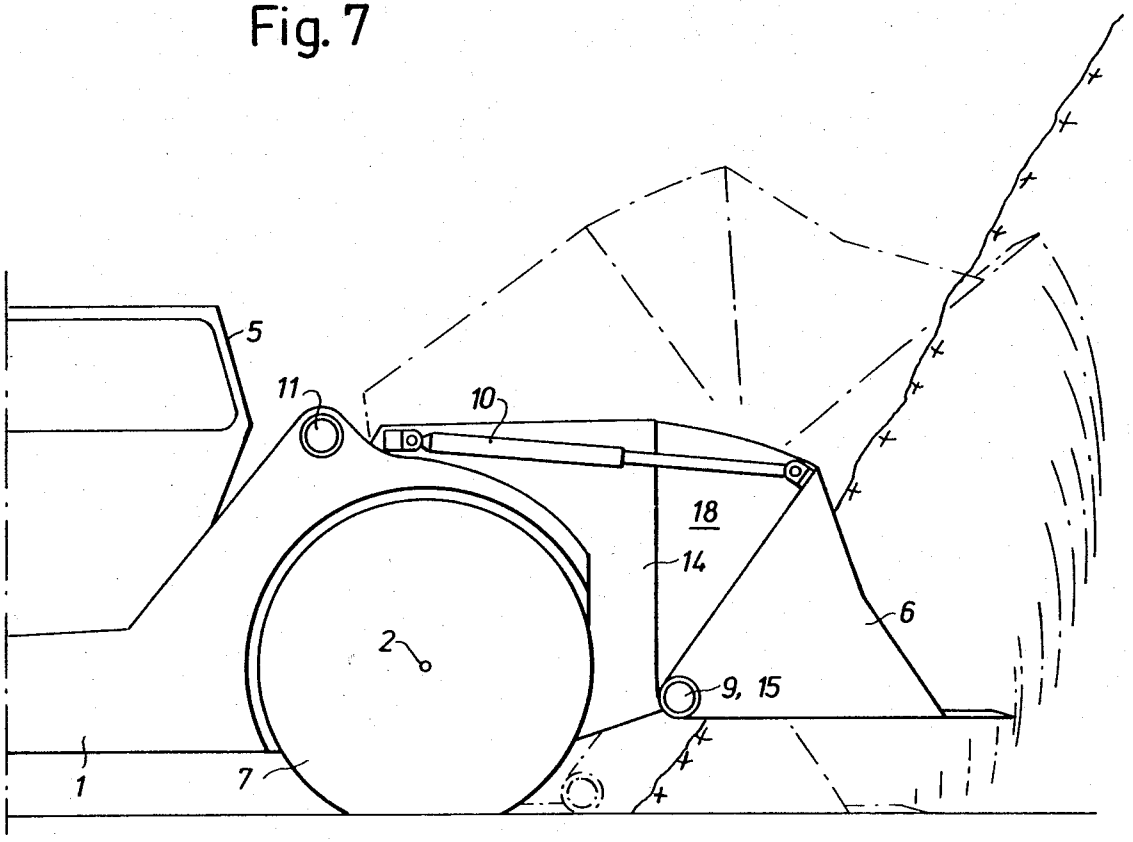
FIG. 7 is a partial side elevational view of the machine for illustration of the working motions of the load bucket.

FIG. 7 diagrammatically illustrates in a side elevational view how the load bucket device according to the present invention operates while the machine is working. Similar to conventional loading machines the present machine is intended when being loaded to be driven up to the heap of bulk material from which loading is to be carried out, with the bucket 6 pushed into the heap with the bucket in its lowermost position as illustrated with broken lines in FIG. 7 of the drawings and as far into the heap as the wheel friction allows. Preferably the machine has conventionally driven rear wheels 3 but a suitable auxiliary drive, for example by a hydraulic motor at each front wheel 2. The main drive power source then is disengaged and the auxiliary drive activated with a suitable forward drive torque which prevents the machine from being moved rearwardly when the load bucket then is brought to carry out a forward-upward digging and loading motion with the lift arms 8 by means of the hydraulic cylinders 12. Should the bulk material for one or the other reason then yield suddenly and more or less fall down into the bucket, the resistance against the bucket motion then also will be relieved and the whole machine therefore automatically moves forwardly into the heap. How far the bucket initially penetrates into the bulk heap is of course dependent, for example, on the force with which the machine is driven forward and how coarse the material is in the heap. The penetration also is dependent on the width of the bucket 6 and the inclination of the side walls thereof.

For a given combination of pressure force, coarseness of material and shape of the load bucket 6, it is also possible to substantially increase the penetration of the bucket in a manner known per se, by rocking the bucket 6 back and forth about its pivot axis 9 by means of the hydraulic cylinders 10. Such rocking motion by means of the hydraulic cylinders 10 can be provided, for example, by means of a tone generator which acts on the cylinders. In doing so it is suitable that the frequency as well as the amplitude of such rocking motions can be varied.

In FIG. 7 of the drawings it has also been illustrated with broken lines a raised position of the bucket 6. From FIG. 7 it is evident that the load in the bucket 6 under the action of gravity tends to fall backwards down into the rear bucket portion 15. As far as loading of iron ore and other bulk material which has an angle of repose of about 60 degrees as illustrated in FIG. 7, an advantageous condition can be achieved with the device according to the invention. That is, the whole combined bucket 6, 14 can be almost entirely filled in one simple working stroke of the lift arms 8. Should the combined bucket not be completely filled in one single working stroke of the lift arms 8, it is of course possible to first pivot the bucket 6 upwardly about its pivot axis 9 by means of the hydraulic cylinders 10, so that the main portion of the load in the bucket will be transferred backwardly to the rear bucket portion 14. Then, the lift arms 8 are lowered, all the way to the initial position, if desired, and a new working stroke of the lift arms 8 is carried out for completing filling of the bucket 6. If desired, the machine then also first might be reversed somewhat and then again driven into the heap of bulk material.

From the side elevational view in FIG. 7 is also evident to those skilled in the art that the position of the pivotal connection 11 of the lift arms 8 to the machine will be determining for the curved motion path of the working motion of the bucket 6 and its pivot axis 9. By suitable location of the pivots 11, particularly vertically, the machine easily can be adapted to superficial or deeper loading in a heap of bulk material, so-called skim loading or deep loading. In the illustrated embodiment of the drawing the pivots 11 have been located substantially at the same vertical level as the upper edge of the rear bucket portion 14 in the initial or hauling position thereof.

A decisive and unique advantage of the machine according to the present invention is that from the driver's compartment 5 with normal height above the ground, the operator of the machine can look over the rear edge of the rear bucket portion 14 and down through the bucket 6 and forwardly beyond said leading edge. If desired, the upper portion 14*a* of the rear bucket portion 14 can be made perforated, i.e. in the form of a screen or expanded metal such that the operator can see therethrough. As a result, it will be possible for the operator to operate the machine in a much more effective manner in preparation for loading but also during the very loading, which otherwise is quite impossible in conventional loading machines.

The bucket device suggested according to the present invention provides an increase of about 50% of the load-carrying capability for a given machine size. In other words, in a machine of the size initially mentioned and having a deadweight of about 32.5 metric tons, the machine can load about 21.5 metric tons in the combined bucket 6, 14, which implies that the machine can load about 66 percent of its deadweight. This is to be compared to the initially mentioned kind of machine which for more than 30 metric tons deadweight can load 12 metric tons in the bucket, that is, about 40 percent of its deadweight. The load distribution in the machine according to the invention also will be essentially different from the conventional type of machine. Even though the present machine design has a load distribution of 14 percent on the front axle and 86 percent of the rear axle in unloaded condition, which is inferior to previously known types of machines but of less determining importance to the wear, the machine has in loaded condition a weight distribution of 61 percent on the front axle and 39 percent on the rear axle when fully loaded, while on the contrary the known machine type has a weight distribution of 70 percent on the front axle and 30 percent on the rear axle when fully loaded. The more uniform full load distribution according to the invention is extremely advantageous and has a strong reducing influence on the wear of the machine.

I claim:

1. In a bucket-equipped loading machine, particularly a so-called wheel loader, which has a loading bucket at one end of the machine, the bucket being supported for raising and lowering movements by a pair of lift arms which are journalled in the machine, the bucket furthermore being pivotally connected with the free ends of the arms and lockable in position relative thereto, the bucket at the side thereof facing the machine being at least partly open and connected with a rear bucket portion which is located between the lift arms and which extends in between the adjacent wheels of the machine, the improvement comprising said rear bucket portion being separately pivotably and lockably connected with said lift arms on an axis parallel to and coinciding with the pivot axis of the load bucket and said lift arms being curved downwardly and forwardly and adapted to form a support during loading and transport for said rear bucket portion, said rear bucket portion resting on and having a curved shape corresponding to said support formed by said lift arms.

2. An improvement according to claim 1, wherein the pivot journal of each of said lift arms in the frame of the machine is located vertically at a level substantially corresponding to the location of the upper edge of said rear bucket portion.

3. An improvement according to claim 1, wherein said rear bucket portion extends above and behind the axis of rotation of the wheels.

4. An improvement according to claim 1, wherein said axis of said rear bucket portion and said pivot axis of the load bucket are located on the lower sides of said rear bucket portion and said load bucket.

* * * * *